US009593391B2

(12) United States Patent
Rout et al.

(10) Patent No.: US 9,593,391 B2
(45) Date of Patent: Mar. 14, 2017

(54) STRIP, SHEET OR BLANK SUITABLE FOR HOT FORMING AND PROCESS FOR THE PRODUCTION THEREOF

(75) Inventors: Tapan Kumar Rout, Odisha (IN); Johnson Go, Batu Pahat (MY); Anil Vilas Gaikwad, Haarlem (NL)

(73) Assignee: TATA STEEL NEDERLAND TECHNOLOGY BV, Ijmuiden (NL)

( * ) Notice: Subject to any disclaimer, the term of this patent is extended or adjusted under 35 U.S.C. 154(b) by 1217 days.

(21) Appl. No.: 13/575,413

(22) PCT Filed: Feb. 18, 2011

(86) PCT No.: PCT/EP2011/000785

§ 371 (c)(1),
(2), (4) Date: Aug. 29, 2012

(87) PCT Pub. No.: WO2011/101158

PCT Pub. Date: Aug. 25, 2011

(65) Prior Publication Data

US 2012/0328871 A1 Dec. 27, 2012

(30) Foreign Application Priority Data

Feb. 19, 2010 (EP) ..... 10001707

(51) Int. Cl.

| | |
|---|---|
| ***C21D 8/02*** | (2006.01) |
| ***C21D 8/04*** | (2006.01) |
| ***C21D 1/673*** | (2006.01) |
| ***C21D 9/48*** | (2006.01) |
| ***C21D 1/68*** | (2006.01) |
| ***C23C 18/12*** | (2006.01) |
| ***C23C 24/08*** | (2006.01) |
| ***C23C 28/00*** | (2006.01) |
| ***C23C 30/00*** | (2006.01) |

(52) U.S. Cl.

CPC ..... *C21D 1/673* (2013.01); *C21D 1/68* (2013.01); *C21D 8/0278* (2013.01); *C21D 8/0478* (2013.01); *C21D 9/48* (2013.01); *C23C 18/127* (2013.01); *C23C 18/1216* (2013.01); *C23C 24/082* (2013.01); *C23C 28/321* (2013.01); *C23C 28/3225* (2013.01); *C23C 28/345* (2013.01); *C23C 30/00* (2013.01); *Y10T 428/265* (2015.01)

(58) Field of Classification Search

None

See application file for complete search history.

(56) References Cited

U.S. PATENT DOCUMENTS

| | | | | |
|---|---|---|---|---|
| 4,668,298 | A * | 5/1987 | Funahashi | H05B 7/12 106/286.8 |
| 2001/0042393 | A1 | 11/2001 | Kefferstein et al. | |
| 2007/0000117 | A1 | 1/2007 | Brandstatter et al. | |
| 2007/0163685 | A1 * | 7/2007 | Kusumi | C21D 1/673 148/530 |
| 2007/0256808 | A1 | 11/2007 | Fleischanderl et al. | |
| 2007/0271978 | A1 | 11/2007 | Brandstatter et al. | |
| 2011/0045316 | A1 | 2/2011 | Brandstatter et al. | |
| 2011/0076477 | A1 | 3/2011 | Brandstatter et al. | |

FOREIGN PATENT DOCUMENTS

| | | | |
|---|---|---|---|
| BE | 1014997 | A3 | 8/2004 |
| DE | 102007022174 | B3 | 9/2008 |
| DE | 102007061489 | A1 | 6/2009 |
| EM | 0971044 | A1 | 1/2000 |
| EP | 1143029 | A1 | 10/2001 |
| EP | 1826289 | A1 | 8/2007 |
| GB | 1490535 | A | 11/1977 |
| JP | 8325689 | A | 12/1996 |
| JP | 9053187 | A | 2/1997 |
| JP | 10204580 | A | 8/1998 |
| WO | 2005021820 | A1 | 3/2005 |
| WO | 2005021822 | A1 | 3/2005 |

OTHER PUBLICATIONS

Acheson, Product Data Sheet for Berkatekt 12 protective coating, 2009.*

International Search Report dated May 2, 2011 from International Application PCT/EP2011/000785 (WO 2011/101158 A1 ), filed Feb. 18, 2011.

Wikipedia, Clay minerals, URL:<https://en.wikipedia.org/wiki/Clay_minerals>, retrieved from the Internet Dec. 12, 2015.

Wikipedia, Clay, URL:<https://en.wikipedia.org/wiki/Clay>, retrieved from the Internet Dec. 12, 2015.

Merriam-Webster Online Dictionary, Red Oxide, URL:<http://www.merriam-webster.com/dictionary/red%20oxide>, retrieved from the Internet Dec. 12, 2015.

Stamping 101: Material Guidelines, Daniel J. Schaeffler, Stamping Journal, issue 216, first published Jan. 15, 2008, reprinted by FMA, The Fabricator.com, Fabricators and Manufacturers Association, Intl., URL: <http://www.thefabricator.com/article/metalsmaterials/stamping-101-material-guidelines>, retrieved from the Internet Jul. 20, 2016.

Work Hardening, Wikipedia, URL: <https://en.wikipedia.org/wiki/Work_hardening>, retrieved from the Internet Jul. 21, 2016.

AKSteel, 17-4 PH® Stainless Steel, Product Data Bulletin, Apr. 22, 2014.

Shop sheet 101, Hot Forming and heat treatment of duplex stainless steels, Excerpt from "Practical Guidelines for the Fabrication of Duplex Stainless Steels" Second Edition 2009, Produced by IMOA, Jul. 2014.

Nimonic, Wikipedia, URL : < https://en.wikipedia.org/wiki/Nimonic >, retrieved from the Internet Jul. 17, 2016.

Magnesium Peroxide, CAS No. 1335-26-8, Product Safety Summary, Solvay America, Inc., 2011.

Magnesium oxide, Safety Data Sheet, SIGMA-ALDRICH, Sep. 19, 2012.

Material Comparison: Boron-Treated Steels, KVA, Inc., URL: < https://www.kvastainless.com/pdf/KVA_boron_compare.pdf >, retrieved from the Internet Feb. 16, 2012.

* cited by examiner

*Primary Examiner* — Sheeba Ahmed

(74) *Attorney, Agent, or Firm* — Vorys, Sater, Seymour and Pease LLP

(57) ABSTRACT

Disclosed is a strip, sheet or blank suitable for hot forming at a temperature of 700° C. or above, including a substrate of hot formable steel, optionally coated with an active corrosion protective coating. The optionally coated steel substrate is provided with a ceramic based coating having a thickness of at most 25 micron. Also disclosed is a process to produce such strip, sheet or blank.

26 Claims, No Drawings

STRIP, SHEET OR BLANK SUITABLE FOR HOT FORMING AND PROCESS FOR THE PRODUCTION THEREOF

CROSS-REFERENCE TO RELATED APPLICATIONS

This is a §371 National Stage Application of International Application No. PCT/EP2011/000785 filed on 18 Feb. 2011, claiming the priority of European Patent Application No. 10001707.8 filed on 19 Feb. 2010.

The invention relates to a strip, sheet or blank suitable for hot forming at a temperature of 700° C. or above, comprising a substrate of hot formable steel, optionally coated with an active corrosion protective coating. The invention also relates to a process for producing such a strip, sheet or blank.

Such an uncoated strip, sheet or blank is known, for instance from GB 1490535, and a coated strip, sheet or blank is known from EP 0971044, relating to an Al—Si coated boron steel; the process of hot forming a zinc coated boron steel is known from for instance EP 1143029.

Uncoated boron steels are known to form Fe oxides during the heat treatment preceding the hot forming step in a die, as a consequence whereof loose and thick oxide layers are formed on the surface, which can pollute and damage the surface of the die. Moreover, such oxide layers interfere with the welding process of the formed product during the subsequent use of the formed product, and also contaminate subsequent painting processes. Therefore, the oxide layers have to be removed after the hot forming process of the uncoated steel products, which is inefficient and costly.

To overcome the above problems, coated boron steels have been developed, and the boron steel substrate has been covered with a metallic coating such as an Al—Si coating and a Zn based coating. So far, it has been found that it is difficult to keep the boron steel substrate covered by the metallic coating during heating and hot press forming. It is expected that this is due to removal of the metallic oxide during the heat treatment, for instance by evaporation.

It is an object of the invention to provide a strip, sheet or blank suitable for hot forming with which the Fe oxide formation of uncoated steel sheets for hot forming is considerably reduced.

It is a further object of the invention to provide a steel sheet coated with an active corrosion protective coating suitable for hot forming that has an improved retainment of the coating during hot forming.

It is another object of the invention to provide a strip, sheet or blank suitable for hot forming having improved properties, such as reduced oxide formation or improved retainment of the coating for active corrosion protection, at low cost.

It is also an object of the invention to provide a process for the production of a strip, sheet or blank that meets one or more of the objects hereinabove.

According to the invention one or more of the above objects are reached with a strip, sheet or blank suitable for hot forming at a temperature of 700° C. or above, comprising a substrate of hot formable steel, optionally coated with an active corrosion protective coating, characterised in that the optionally coated steel substrate is provided with a ceramic based coating having a thickness of at most 25 micron.

The inventors have found that such a ceramic coating is very suitable to greatly reduce the extent of oxidation of an uncoated steel strip, sheet and blank during the hot forming. No loose oxides were observed on the surface of the heated ceramic coated steel. The ceramic coating also retains the coating for active corrosion protection if present on the steel. The inventors have found that the thickness of the ceramic coating should be at most 25 micron since with higher thickness the coating may delaminate from the steel. The strip, sheet and blank can be used at temperatures between 700° C. and 1200° C., preferably between 800° C. and 1000° C.

Preferably, the ceramic based coating comprises at least one of the group of ceramic oxides consisting of $SiO_2$, $Al_2O_3$, $MnO_2$, CaO, $MgO_2$, $Fe_2O_3$, $CeO_2$, $CeNO_3$, AgO, ZnO, $SnO_2$, $V_2O_5$ and $HfO_2$. Each of these ceramic oxides or a combination thereof forms a ceramic coating that reduces the oxidation of an uncoated strip, sheet or blank during hot forming, or retains the corrosion protective coating on the steel substrate.

According to a preferred embodiment the ceramic based coating comprises $SiO_2$, $Al_2O_3$ and $MgO_2$ and optionally CaO, $Fe_2O_3$ and $MnO_2$. This combination of ceramic oxides provides a good ceramic based coating for the purpose.

Preferably the ceramic based coating comprised 5-80% $SiO_2$, 1-30% $Al_2O_3$ and 1-30% $MgO_2$, and optionally max 5% CaO, max 10% $Fe_2O_3$ and max 10% $MnO_2$. These percentages (in volume %) of ceramic oxides provide a good ceramic based coating which can be produced at low cost.

According to a preferred embodiment the ceramic based coating also comprises at least one of the group consisting of polyimide polymer, acrylic polymer, poly vinyl, poly vinyl alcohol, polyurethane and silicone oil. These materials provide flexibility to the ceramic based coating.

Preferably the ceramic based coating has a thickness of between 1 and 15 micron, preferably between 1 and 10 micron, more preferably between 2 and 5 micron. Of course a thinner coating has a lower cost; moreover, the ceramic based coating has to provide its function during the hot forming process only, which generally last only a few minutes to heat the blank and uses a very short time for the hot pressing and quenching. The coating can be applied by a spray coater, by dip coating, by a roll coater or a chemical coater, or by electrodeposition techniques.

According to a preferred embodiment, the ceramic based coating comprises carbon black, carbon fibres, carbon nanotubes and/or nano-clays. These filler-type materials provide an additional corrosion protection to the ceramic based coating. The naotubes can be single-walled carbon nanotubes (SWCNTs), double-walled carbon nanotubes (DWCNTs) and/or multi-walled carbon nanotubes (MWCNTs).

According to a further preferred embodiment the ceramic based coating comprised metallic pigments, such as zinc, aluminium, titania, chromate, red-oxide or magnesium pigments, preferably the metallic pigments being coated or encapsulated or derived from their alkoxide precursors. The metallic based pigments, such as zinc, aluminium, titania, chromate, red-oxid or magnesium pigments, in themselves give an active corrosion protection, especially when no active corrosion protection layer is present.

According to a still further preferred embodiment the ceramic based coating comprises metallic fillers as expansion agents, such as Al, Fe, Sn and/or Zr. Such fillers give an additional corrosion protection and provide the ceramic based layer at lower cost.

Preferably the hot formable steel substrate is a boron steel substrate, more preferably having the composition in weight percent:

C between 0.04 and 0.5%

Mn between 0.5 and 3.5%

Si less than 1.0%

Cr 0.01 and 1.0%
Ti less than 0.2%
Al less than 2.0%
P less than 0.1%
N less than 0.015%
S less than 0.05%
B less than 0.015%
the remainder being Fe and unavoidable impurities.

Such steel types are generally known and used for hot forming purposes.

According to a preferred embodiment an active corrosion protective coating is present on the hot formable steel substrate, the active corrosion protective coating being a coating of one of the group of zinc based coating, aluminium based coating, cerium based coating, ZrO2 based coating, Fe—Zn based coating, magnesium pigment based coating. These are known active corrosion protective coatings, which profit from the ceramic based coating according to the invention which helps retaining the active corrosion protective coating on the steel during hot forming.

According to a second aspect of the invention there is provided a process for producing a strip, sheet or blank suitable for hot forming at a temperature of 700° C. or above according to the first aspect of the invention above, wherein solid particles comprising at least one of the group of ceramic oxides and/or their metal alkoxides consisting of $SiO_2$, $Al_2O_3$, $MnO_2$, CaO, $MgO_2$, $Fe_2O_3$, $CeO_2$, $CeNO_3$, AgO, ZnO, $SnO_2$, $V_2O_5$ and $HfO_2$ are mixed in a solvent based system or water based system and applied on the strip, sheet or blank in a layer of at most 50 micron, after which the strip, sheet or blank is cured at a temperature of at most 400° C. to remove the solvent or water and to sinter the ceramic oxides.

Using such solid particles and mixing them in a solvent or water based system makes it possible to apply the solvent or water based ceramic system on the strip, sheet or blank at a layer of at most 50 micron, such that after removing the solvent or water and sintering of the ceramic oxides a ceramic based layer is formed having a thickness of at most 25 micron.

According to a preferred embodiment, solid particles comprising ceramic oxides consisting of $SiO_2$, $Al_2O_3$ and $MgO_2$ and optionally CaO, $MnO_2$ and $Fe_2O_3$ are mixed in the solvent based system or water based system, preferably 5-80% $SiO_2$, 1-30% $Al_2O_3$ and 1-30% $MgO_2$ and optionally max 5% CaO, max 10% $MnO_2$ and max 10% $Fe_2O_3$, and wherein optionally carbon black, carbon fibres, carbon nanotubes and/or nano-clays are mixed in the solvent based system or water based system and wherein optionally metallic pigments, such as zinc, alumina or magnesium pigments, preferably the metallic pigments being coated or encapsulated, are mixed in the solvent based system or water based system, and wherein preferably an active corrosion protective coating is present on the hot formable steel substrate, the active corrosion protective coating being a coating of one of the group of zinc based coating, aluminium based coating, cerium based coating, ZrO2 based coating, Fe—Zn based coating, magnesium pigmented coating. In this way a strip, sheet or blank is produced according to the first aspect of the invention.

Preferably an oxide layer on the metal substrate is removed prior to the application of the ceramic based layer on the metal substrate. Removing the oxide layer provides a better adhesion between the metal substrate and the ceramic based coating.

According to a preferred embodiment the temperature to cure and sinter the coating is performed at a temperature between 50 and 150° C. Using this temperature range provides an economic process and well-sintered ceramic oxides.

The invention will be elucidated referring to the examples given below.

In a first experiment, a sample of an uncoated cold rolled boron steel has been compared with cold rolled boron steel coated with a ceramic based coating.

The boron steel used has a composition of 0.21 C, 0.192 Si, 1.189 Mn, 0.022 Ni, 0.25 Cr, 0.044 Al tot, 0.013 P, 0.035 Ti, 62 ppm N, 0.006 S and 31 ppm B (all in weight % but N and B).

The coating used is the commercially available Berkatekt 12® manufactured by Henkel. This coating has a composition of 32-36% $SiO_2$, 8-9% $Al_2O_3$, <1% CaO, 7.5-10% $MgO_2$ and <2% $Fe_2O_3$, mixed in an organic compound. The coating can be applied by spraying or dipping. In this first experiment, the coating was applied by spraying after the surface of the boron steel had been thoroughly cleaned. A first coating has been applied having a thickness of 0.293 mg/cm$^2$ (after curing and sintering), a second coating has been applied having a thickness of 0.389 mg/cm$^2$ (after curing and sintering).

For the uncoated cold rolled sample, thick and loose Fe oxides were found on the sample surface after heating up to 900° C. during 5 minutes. Examined in SEM micrographs, large cracks were observed in the oxide layers on the surface of the sample.

Both the samples using a Berkatekt 12® coating showed that the extent of Fe oxidation during the high temperature heat treatment is reduced significantly. Both hematite and magnetite formation were considerably suppressed during heating up to 900° C. during 5 minutes.

In a second experiment, a sample of a cold rolled boron steel coated with an active corrosion protective layer has been compared with such a sample coated with a ceramic based coating.

The boron steel substrate used has a composition of 0.21 C, 0.192 Si, 1.189 Mn, 0.022 Ni, 0.25 Cr, 0.044 Al tot, 0.013 P, 0.035 Ti, 62 ppm N, 0.006 S and 31 ppm B (all in weight % but N and B).

The active corrosion protective layer in this experiment is a zinc alloy layer using 1.6 weight % Mg and 1.6 weight % Al, the remainder being zinc (called MagiZinc®). The thickness of the zinc alloy layer is 70 g/m$^2$.

The coating used again is Berkatekt 12® applied in the same way as in the first experiment. A first coating has been applied having a thickness of 0.173 mg/cm$^2$ (after curing and sintering), a second coating has been applied having a thickness of 0.335 mg/cm$^2$ (after curing and sintering).

The sample without the ceramic coating shows quite severe oxidation of the zinc alloy layer after heating up to 900° C. during 5 minutes. A thick zinc oxide layer was observed in SEM micrographs.

Both the samples using a Berkatekt 12® coating on the zinc alloy layer showed that the extent of zinc oxidation during the high temperature heat treatment of 900° C. during 5 minutes is reduced significantly, as shown in SEM micrographs. In addition, it is likely that the ceramic coating prevented excessive evaporation of the zinc, and therefore higher amounts of zinc were retained in the FeZn layer (which is formed during the heating). Higher amounts of zinc will lead to improved active corrosion protection.

When no loose oxide layers are produced during hot forming (as in the case of the above ceramic coated samples) additional surface conditioning is not necessary after hot forming.

The ceramic coating can be applied for both direct and indirect hot forming processes, although it is expected to perform better in the former.

The examples show that the coating weight can be varied from approximately 0.2 mg/cm$^2$ up to approximately 0.4 mg/cm$^2$ without influencing significantly the performance of the coating.

In a third experiment uncoated and ceramic coated sampled that had first been provided with an active corrosion protective layer were subjected to a salt spray test and to electrical resistance tests.

The boron steel substrate used has a composition of 0.21 C, 0.192 Si, 1.189 Mn, 0.022 Ni, 0.25 Cr, 0.044 Al tot, 0.013 P, 0.035 Ti, 62 ppm N, 0.006 S and 31 ppm B (all in weight % but N and B).

The active corrosion protective layers in this experiment is a zinc alloy layer using 1.6 weight % Mg and 1.6 weight % Al, the remainder being zinc (called MagiZinc®), and GI. The thickness of the zinc alloy layer and GI layer is 140 g/m$^2$.

Prior to the measurements, the samples were treated in a preheated furnace under air at 900° C. during 5 minutes.

An electrical resistance test was performed so as to indirectly evaluate the weldability of coatings. From the literature it is known that for conventional weldable coatings the electrical resistance should be on average below 5 milli-ohms.

The experimental setup for measuring the electrical resistance consists of two copper electrodes (diameter=12.5 mm), a low ohm meter (Rhopoint Instrument M210), a pressure gauge and a pneumatic press (capable of 15 ton pressure). The low ohm meter has a resolution of 1 milli-ohm and its copper wires were soldered directly into the copper electrodes to avoid any potential resistance contribution from the setup. The copper electrode surfaces in contact with the testing samples were ground on 4000 grit silicone carbide paper before use, while the reverse sides were covered with insulating tape.

The ceramic coating used was a Berkatekt 12® coating as in the first experiment. The coating has a thickness of 0.2 mg/cm$^2$ (after curing and sintering).

The ceramic coating applied on the MagiZinc® coating gives an electrical resistance of 3 milli-ohms for the sample. The ceramic coating applied on the GI coating gives an electrical resistance of 2 milli-ohms for the sample. This is a significant improvement over a MagiZinc® coating and GI coating without the ceramic layer, and thus very good for industrial welding.

The salt spray test was performed on samples of both ceramic coated MagiZinc® coated and GI coated boron steel, and on MagiZinc® coated and GI coated boron steel not coated with a ceramic layer.

The salt spray test was performed according to ASTM B 117, using a 5% NaCl solution at 35° C., with an overpressure of 2-3.5 mbar (200 to 350 Pascal) to create fog inside the spray chamber.

Using the ceramic coating on the above specified active corrosion protective layers gives a slight improvement in corrosion resistance over the samples without ceramic layer. This is acceptable for industrial use.

It will be clear to the skilled person that the invention is not limited to the above described experiments, but that the scope of the invention is determined by the accompanying claims.

The invention claimed is:

1. A strip, sheet or blank suitable for hot forming at a temperature of 700° C. or above, comprising:

a substrate of hot formable steel, optionally the substrate is coated with an active corrosion protective coating, the optionally corrosion protective coating coated steel substrate is provided with a ceramic based coating having a thickness of at most 25 micron on the external layer, wherein the ceramic based coating comprises, in volume percent, 5-80% $SiO_2$, 1-30% $Al_2O_3$ and 1-30% $MgO_2$, and optionally max 5% CaO, max 10% $Fe_2O_3$ and max 10% $MnO_2$, wherein the hot formable steel substrate is a boron steel substrate.

2. The strip, sheet or blank according to claim 1, wherein the ceramic based coating also comprises at least one of the group consisting of polyimide polymer, acrylic polymer, poly vinyl polymer, poly vinyl alcohol, polyurethane and silicone oil.

3. The strip, sheet or blank according to claim 1, wherein the ceramic based coating has a thickness of between 1 and 15 micron.

4. The strip, sheet or blank according to claim 1, wherein the ceramic based coating comprises carbon black, carbon fibres, carbon nanotubes and/or nano-clays.

5. The strip, sheet or blank according to claim 1, wherein the ceramic based coating comprises metallic pigments.

6. The strip, sheet or blank according to claim 1, wherein the ceramic based coating comprises metallic fillers as expansion agents.

7. The strip, sheet or blank according to claim 1, wherein an active corrosion protective coating is present on the hot formable steel substrate, the active corrosion protective coating being selected from the group consisting of zinc based coating, aluminium based coating, cerium based coating, ZrO2 based coating, Fe—Zn based coating, and magnesium based coating.

8. A process for producing a strip, sheet or blank suitable for hot forming at a temperature of 700° C. or above according to claim 1, comprising providing a substrate of hot formable steel for the strip, sheet or blank, wherein the hot formable steel substrate is a boron steel substrate, optionally coating the substrate with an active corrosion protective coating, mixing a mixture of solid particles comprising ceramic oxides and/or their metal alkoxides consisting of $SiO_2$, $Al_2O_3$ and $MgO_2$, and optionally $MnO_2$, CaO and $Fe_2O_3$, in a solvent based system or water based system, and applying the mixture on the external layer of the optionally corrosion protective coating coated steel substrate in a mixture layer of at most 50 micron, after which the optionally corrosion protective coating coated steel substrate is cured at a temperature of at most 400° C. to remove the solvent or water and to sinter the ceramic oxides to provide the optionally corrosion protective coating coated steel substrate with a ceramic based coating having a thickness of at most 25 micron on the external layer, wherein the ceramic based coating comprises 5-80% $SiO_2$, 1-30% $Al_2O_3$ and 1-30% $MgO_2$, and optionally max 5% CaO, max 10% $Fe_2O_3$ and max 10% $MnO_2$.

9. The process according to claim 8, wherein the solid particles comprising ceramic oxides consisting of $SiO_2$, $Al_2O_3$ and $MgO_2$ and optionally CaO, $MnO_2$ and $Fe_2O_3$ are mixed in the solvent based system or water based system, and wherein optionally carbon black, carbon fibres, carbon nanotubes and/or nano-clays are mixed in the solvent based system or water based system and wherein optionally metallic pigments, and wherein the active corrosion protective coating is optionally present on the hot formable steel substrate, the active corrosion protective coating being a coating of one of the group of zinc based coating, aluminium based coating, cerium based coating, ZrO2 based coating, Fe—Zn based coating, magnesium based coating.

10. The process according to claim 8, wherein an oxide layer on the metal substrate is removed prior to the application of the ceramic based layer on the metal substrate.

11. The process according to claim 8, wherein the temperature to cure and sinter the coating is performed at a temperature between 50 and 150° C.

12. The strip, sheet or blank according to claim 1, wherein the ceramic based coating has a thickness of between 1 and 10 micron.

13. The strip, sheet or blank according to claim 1, wherein the ceramic based coating has a thickness of between 2 and 5 micron.

14. The strip, sheet or blank according to claim 1, wherein the ceramic based coating comprises metallic pigments, selected from the group consisting of zinc, aluminium, titania, chromate, red-oxide and magnesium pigments.

15. The strip, sheet or blank according to claim 1, wherein the ceramic based coating comprises metallic pigments, selected from the group consisting of zinc, aluminium, titania, chromate, red-oxide and magnesium pigments, the metallic pigments being coated or encapsulated or derived from their alkoxide precursors.

16. The strip, sheet or blank according to claim 1, wherein the ceramic based coating comprises metallic fillers as expansion agents, selected from at least on member of the group consisting of Al, Fe, Sn, Cr, Ti and Zr.

17. The strip, sheet or blank according to claim 1, wherein the hot formable steel substrate is a boron steel substrate, having the composition in weight percent:

C between 0.04 and 0.5%
Mn between 0.5 and 3.5%
Si less than 1.0%
Cr 0.01 and 1.0%
Ti less than 0.2%
Al less than 2.0%
P less than 0.1%
N less than 0.015%
S less than 0.05%
B less than 0.015%
the remainder being Fe and unavoidable impurities.

18. The process according to claim 8, wherein the solid particles comprising ceramic oxides consisting of $SiO_2$, $Al_2O_3$ and $MgO_2$ and optionally CaO, $MnO_2$ and $Fe_2O_3$ are mixed in the solvent based system or water based system, comprising 5-80% $SiO_2$, 1-30% $Al_2O_3$ and 1-30% $MgO_2$ and optionally max 5% CaO, max 10% $MnO_2$ and max 10% $Fe_2O_3$, and wherein optionally carbon black, carbon fibres, carbon nanotubes and/or nano-clays are mixed in the solvent based system or water based system and wherein optionally metallic pigments, selected from the group consisting of zinc, alumina or magnesium pigments, the metallic pigments being coated or encapsulated, are mixed in the solvent based system or water based system, and wherein the active corrosion protective coating is optionally present on the hot formable steel substrate, the active corrosion protective coating being a coating of one of the group of zinc based coating, aluminium based coating, cerium based coating, ZrO2 based coating, Fe—Zn based coating, magnesium based coating.

19. The process according to claim 8, wherein the solid particles comprising ceramic oxides consisting of $SiO_2$, $Al_2O_3$ and $MgO_2$ and optionally CaO, $MnO_2$ and $Fe_2O_3$ are mixed in the solvent based system or water based system, comprising 5-80% $SiO_2$, 1-30% $Al_2O_3$ and 1-30% $MgO_2$ and optionally max 5% CaO, max 10% $MnO_2$ and max 10% $Fe_2O_3$, and wherein optionally carbon black, carbon fibres, carbon nanotubes and/or nano-clays are mixed in the solvent based system or water based system and wherein optionally metallic pigments, selected from the group consisting of zinc, alumina or magnesium pigments, the metallic pigments being coated or encapsulated, are mixed in the solvent based system or water based system, and wherein the active corrosion protective coating is present on the hot formable steel substrate, the active corrosion protective coating being a coating of one of the group of zinc based coating, aluminium based coating, cerium based coating, ZrO2 based coating, Fe—Zn based coating, magnesium based coating.

20. The strip, sheet or blank according to claim 1, wherein the ceramic based coating also comprises at least one of the group consisting of polyimide polymer, acrylic polymer, poly vinyl alcohol, polyurethane and silicone oil.

21. The strip, sheet or blank according to claim 1, wherein the ceramic based coating consists of, in volume percent, 5-80% $SiO_2$, 1-30% $Al_2O_3$ and 1-30% $MgO_2$, and optionally max 5% CaO, max 10% $Fe_2O_3$ and max 10% $MnO_2$, and optionally at least one member of the group consisting of $CeO_2$, $CeNO_3$, AgO, ZnO, $SnO_2$, $V_2O_5$ and $HfO_2$, optionally at least one of the group consisting of polyimide polymer, acrylic polymer, poly vinyl polymer, poly vinyl alcohol, polyurethane and silicone oil, and optionally carbon black, carbon fibres, carbon nanotubes and/or nano-clays, and optionally metallic pigments, selected from the group consisting of zinc, aluminium, titania, chromate, red-oxide or magnesium pigments, and optionally metallic fillers as expansion agents, selected from the group consisting of Al, Fe, Sn, Cr, Ti and/or Zr.

22. The strip, sheet or blank according to claim 1, wherein the ceramic based coating consists of, in volume percent, 5-80% $SiO_2$, 1-30% $Al_2O_3$ and 1-30% $MgO_2$, and optionally max 5% CaO, max 10% $Fe_2O_3$ and max 10% $MnO_2$, and optionally at least one of the group consisting of polyimide polymer, acrylic polymer, poly vinyl alcohol, polyurethane and silicone oil, optionally metallic pigments, selected from the group consisting of zinc, aluminium, titania, chromate, red-oxide or magnesium pigments, and optionally metallic fillers as expansion agents, selected from the group consisting of Al, Fe, Sn, Cr, Ti and/or Zr.

23. The strip, sheet or blank according to claim 1, wherein the ceramic based coating also comprises at least one of the group consisting of polyimide polymer, acrylic polymer, poly vinyl alcohol, polyurethane and silicone oil.

24. The strip, sheet or blank according to claim 1, wherein the ceramic based coating consists of, in volume percent, 5-80% $SiO_2$, 1-30% $Al_2O_3$ and 1-30% $MgO_2$, and max 5% CaO, optionally max 5% CaO, max 10% $Fe_2O_3$ and max 10% $MnO_2$, and optionally at least one member of the group consisting of $CeO_2$, $CeNO_3$, AgO, ZnO, $SnO_2$, $V_2O_5$ and $HfO_2$, optionally at least one of the group consisting of polyimide polymer, acrylic polymer, poly vinyl polymer, poly vinyl alcohol, polyurethane and silicone oil, and optionally carbon black, carbon fibres, carbon nanotubes and/or nano-clays, and optionally metallic pigments, selected from the group consisting of zinc, aluminium, titania, chromate, red-oxide or magnesium pigments, and optionally metallic fillers as expansion agents, selected from the group consisting of Al, Fe, Sn, Cr, Ti and/or Zr.

25. The strip, sheet or blank according to claim 7, wherein the ceramic based coating consists of, in volume percent, 5-80% $SiO_2$, 1-30% $Al_2O_3$ and 1-30% $MgO_2$, and optionally max 5% CaO, max 10% $Fe_2O_3$ and max 10% $MnO_2$, and optionally at least one member of the group consisting of $CeO_2$, $CeNO_3$, AgO, ZnO, $SnO_2$, $V_2O_5$ and $HfO_2$, optionally at least one of the group consisting of polyimide polymer, acrylic polymer, poly vinyl polymer, poly vinyl alcohol, polyurethane and silicone oil, and optionally carbon black, carbon fibres, carbon nanotubes and/or nano-clays, and optionally metallic pigments, selected from the group consisting of zinc, aluminium, titania, chromate, red-oxide or magnesium pigments, and optionally metallic fillers as expansion agents, selected from the group consisting of Al, Fe, Sn, Cr, Ti and/or Zr.

26. The strip, sheet or blank according to claim 17, wherein the ceramic based coating consists of, in volume percent, 5-80% $SiO_2$, 1-30% $Al_2O_3$ and 1-30% $MgO_2$, and optionally max 5% CaO, max 10% $Fe_2O_3$ and max 10% $MnO_2$, and optionally at least one member of the group consisting of $CeO_2$, $CeNO_3$, AgO, ZnO, $SnO_2$, $V_2O_5$ and $HfO_2$, optionally at least one of the group consisting of polyimide polymer, acrylic polymer, poly vinyl polymer, poly vinyl alcohol, polyurethane and silicone oil, and optionally carbon black, carbon fibres, carbon nanotubes and/or nano-clays, and optionally metallic pigments, selected from the group consisting of zinc, aluminium, titania, chromate, red-oxide or magnesium pigments, and optionally metallic fillers as expansion agents, selected from the group consisting of Al, Fe, Sn, Cr, Ti and/or Zr.

* * * * *